United States Patent [19]

Helversen

[11] Patent Number: 4,678,368

[45] Date of Patent: Jul. 7, 1987

[54] CANAL COVERING SYSTEM AND METHOD OF INSTALLING SAME

[76] Inventor: Frederick D. Helversen, 300 Sand Hill Cir. #206, Menlo Park, Calif. 94025

[21] Appl. No.: 884,648

[22] Filed: Jul. 11, 1986

[51] Int. Cl.[4] ..... E02B 5/00; E02B 13/00

[52] U.S. Cl. ..... 405/118; 405/52

[58] Field of Search ..... 405/26, 27, 36, 52, 405/53, 63, 80, 84, 115, 118, 119

[56] References Cited

U.S. PATENT DOCUMENTS

| | | | |
|---|---|---|---|
| 3,029,606 | 4/1962 | Olsen | 405/27 |
| 3,188,813 | 6/1965 | Foster et al. | 405/27 |
| 3,815,367 | 6/1974 | Collins | 405/52 |
| 4,070,864 | 1/1978 | Jarvis | 405/115 |

*Primary Examiner*—David H. Corbin

*Attorney, Agent, or Firm*—Gregory J. Nelson

[57] ABSTRACT

A covering system for canals to minimize evaporization loss from water transportation canals. The system comprises a plurality of strips of liquid impervious materials of predetermined length adjacent one another forming a section. The strips are secured to a transverse support at one end of each section. The strips float on the canal surface in both a flowing and quiescent condition. The sections of strips are spaced so that in the direction of flow adjacent sections overlap a predetermined distance to accommodate fluctuations in the water level in the canal.

10 Claims, 19 Drawing Figures

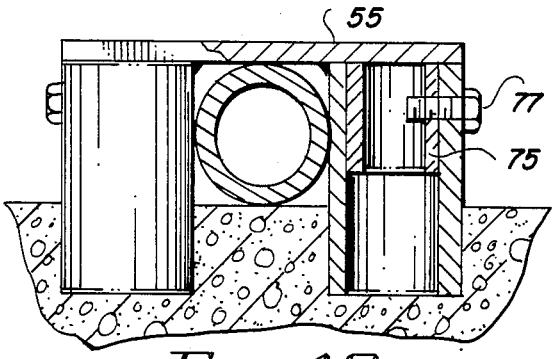
FIG. 10
FIG. 11
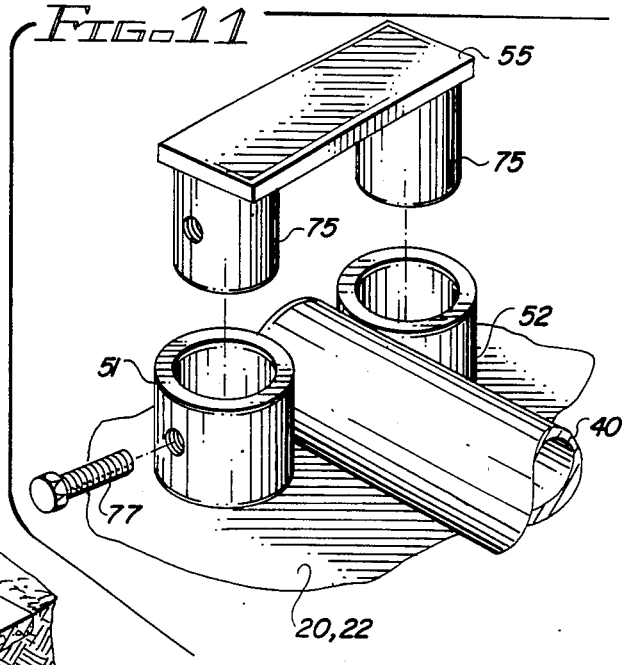
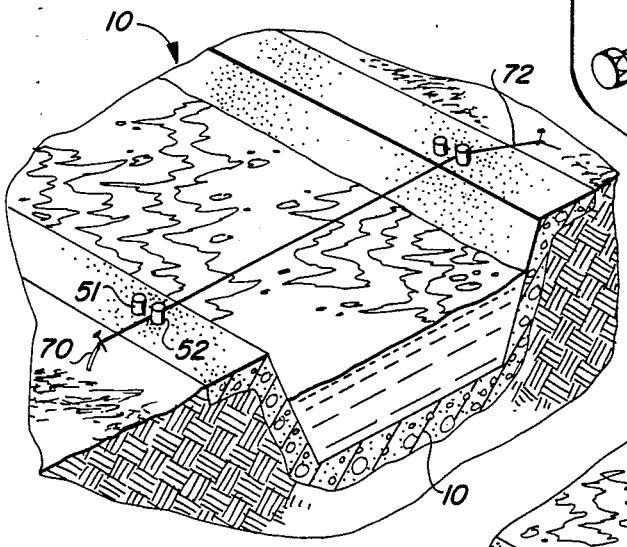
FIG. 12
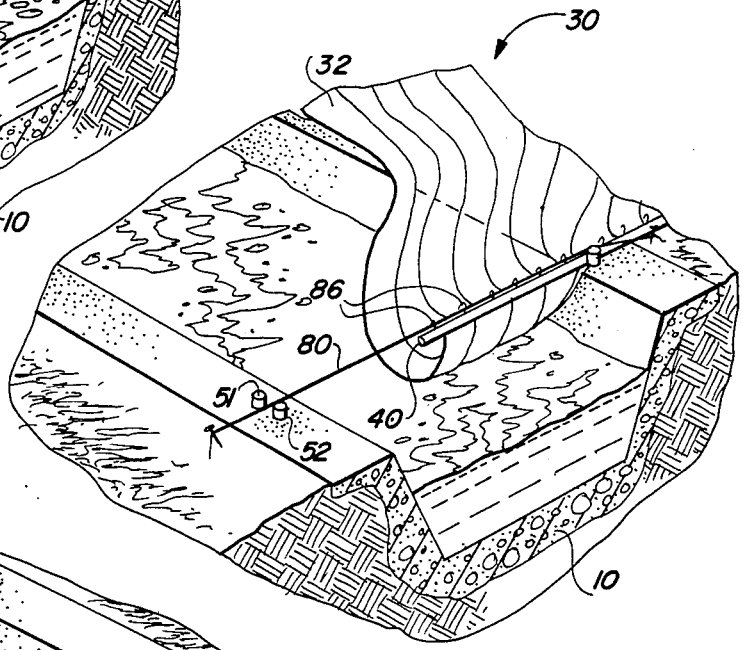
FIG. 13
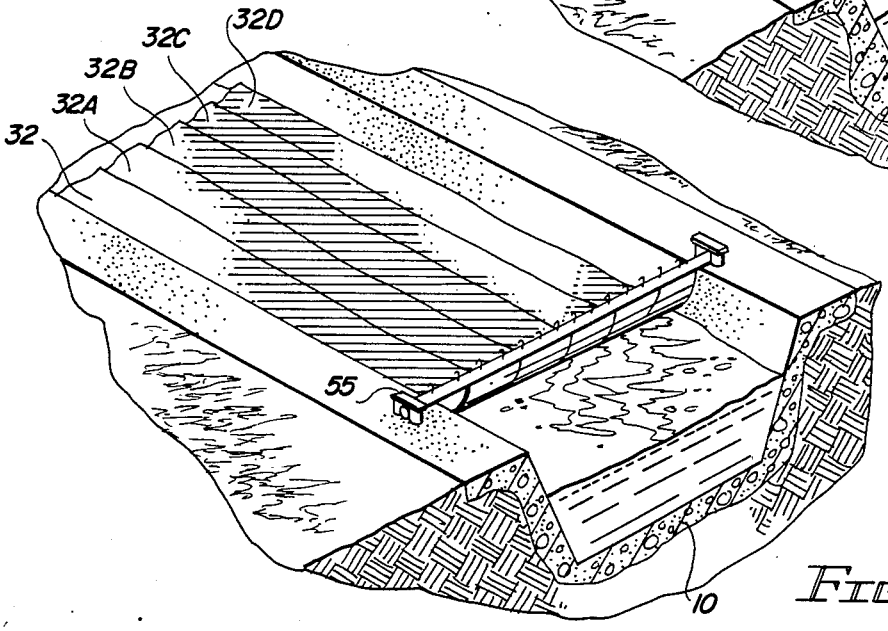
FIG. 14

CANAL COVERING SYSTEM AND METHOD OF INSTALLING SAME

The present invention relates to a cover system for canals confining flowing water and more particularly relates to a covering system to minimize or eliminate evaporation of water from water transportation canals.

Water transportation canals of the type utilizing an open channel for transporting water to specific locations for agricultural and other uses are well known. These canals are quite common in various parts of the world particularly in the Southwestern part of the United States. Canals of this type are designed having a channel open to the environment. It is quite common to line the canal channel with a suitable material such as concrete or other material to minimize erosion, minimize seepage and to prevent undesirable plant growth in the channel. Typical canals of this type are the the Central Arizona Project Canal and the Arizona Canal in Arizona. Large canals of this type are also common in the agricultural regions of California.

Canals of the type described above are often quite wide, often to 100 feet and extend for hundreds of miles and thus have substantial surface area exposed to the environment. During periods of hot weather as is experienced in the summer in the Southwest, substantial evaporation loss can occur from these canals. The water loss is significant and may also result in environmental effects to the areas adjacent the canals. The environmental effects caused by such canals can also be experienced in cooler weather. In certain areas such as San Joaquin Valley, Calif., the agricultural canals parallel major highways in the interstate system. In cool weather, water evaporating from the surface of the canals condenses in the cool air causing dense fog which poses safety hazards to drivers.

Accordingly, there exists a need in the art for an effective system for covering canals to reduce or eliminate evaporation loss which covering system is inexpensive, efficient and easy to install and maintain. A review of the prior art discloses various apparatus and systems for enclosing or covering liquid storage reservoirs. These prior art systems generally relate to some type of impervious floating cover for water reservoirs or, in some cases, chemical or petroleum storage reservoirs. For example, U.S. Pat. No. RE 30,146 shows the use of fabric reinforced rubber or polyethylene sheeting to cover a liquid storage reservoir.

Similarly, U.S. Pat. No. 3,517,513 discloses the use of a floating cover of polystyrene foam to limit evaporation from a water supply.

U.S. Pat. No. 3,815,367 shows a cover assembly for a reservoir which has a flexible, impermeable diaphragm which floats on the upper surface of the liquid. The periphery of the diaphragm is anchored to the containing walls of the reservoir through a resilient tensioning arrangement.

The above patents are representative of the prior art for systems for covering quiescent, non-flowing reservoirs. Such systems do not adapt themselves as covers for water transportation canals because of the substantially different nature and construction of such canals. A covering system for a water transportation canal must be effective to reduce or minimize evaporation and must be cost effective in terms of installation and maintenance. Further, any covering system for a canal must accomodate substantial variations in flow and water level and must also accomodate flow in both directions in the canal. Other criteria require that the covering system be adapted to wide physical differences in canal size, geometry and configuration.

In accordance with the present invention, a system is provided to minimize evaporation loss from water transportation canals. The system consists of a plurality of strips of liquid-impervious, flexible material such as fiberglass, plastic, rubber, reinforced cloth or the like. The strips have a pre-determined specific gravity and are of pre-determined length and are secured at one end at spaced-apart locations along the canal forming a section covering the canal surface. The fixed end may be secured by various clamping arrangements to a transverse support attached at opposite canal banks. The strips will float on the quiescent canal surface and will also retain a position on the top of the canal surface when the water is flowing in either direction. The strip material will not absorb water and is resistive to abrasion and wear. The sections of strips are spaced so that in the direction of flow adjacent strip sections overlap a predetermined distance to accomodate fluctuations in the water level within the canal. The present system also incorporates a method of installing the system which permits a single workman working from one side of the canal to install and remove the cover sections.

The above invention will be more fully appreciated and understood from the following description, claims and drawings in which:

FIG. 10 is an elevational view, partly in section, showing an anchoring arrangement for the cover support;

FIG. 11 is an exploded perspective view of the anchoring arrangement shown in FIG. 10;

FIGS. 12 to 14 illustrate the sequential steps involved in one method of installing the cover utilizing the anchor arrangement shown in FIGS. 10 and 11;

Figure 15:
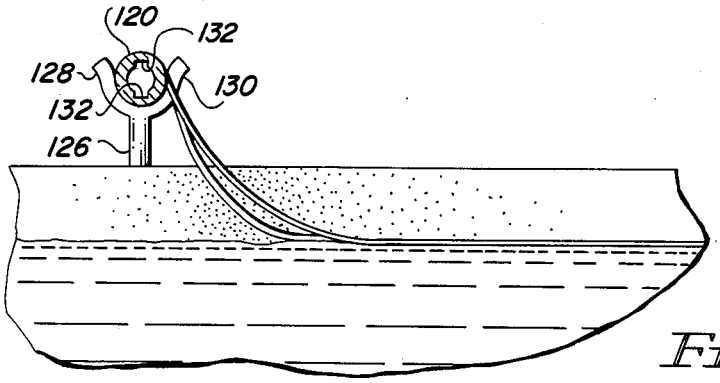
FIG. 15 is a longitudinal section view of a canal section showing an alternate anchoring arrangement for the transverse cover support.
Figure 16:
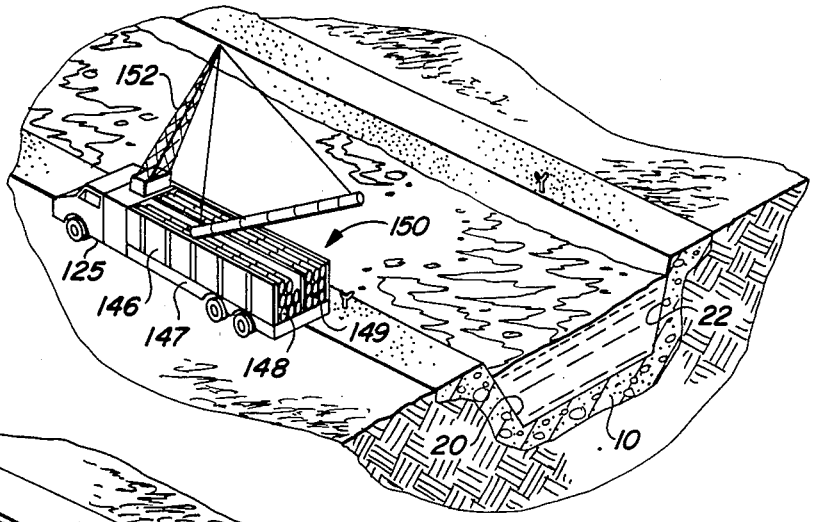
Figure 17:
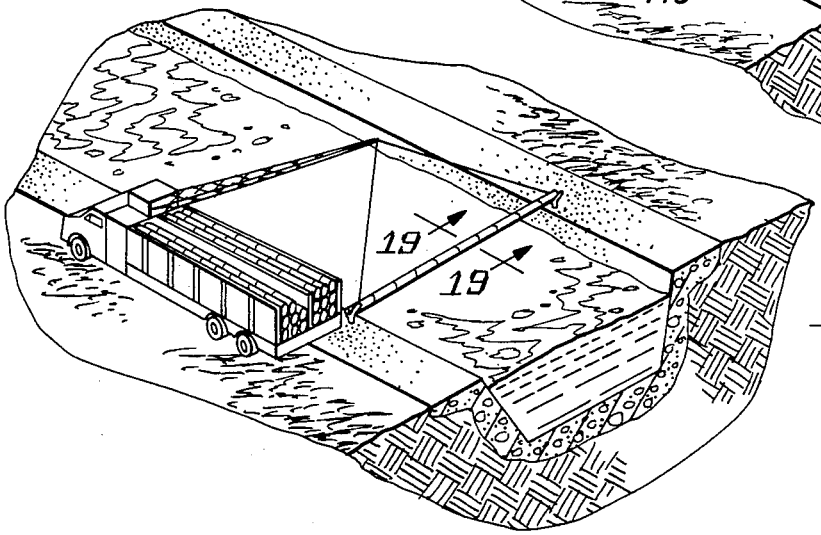
Figure 18:
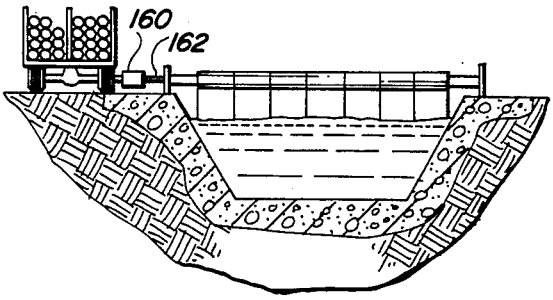
Figure 19:
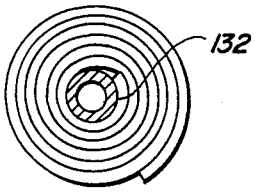

FIGS. 16 through 18 sequentially illustrate a method of installing the cover sections utilizing the achoring arrangement shown in FIG. 15; and FIG. 19 is a sectional view taken along lines 19—19 of FIG. 17 illustrating the transverse support with the cover strip wound about the support.

Turning now to the drawings, FIGS. 1 to 5 illustrate a preferred embodiment of the canal covering system of the present invention which is shown in connection with a canal 10. Canal 10 consists of a channel 12 excavated forming opposite banks 20 and 22 and bottom 14. The channel 12 may be suitably lined with concrete or other material to resist erosion, minimize seepage and prevent undesirable plant growth as well as for aesthetic purposes. The canal 10 of this general type is commonly designed for water transportation for agricultural and other uses. The width of the channel between the opposite banks 20 and 22 may vary and typically would range from 20 to 100 feet and the present invention will adapt to varying canal widths. For purposes of description of the present invention, the water in the canal is shown as having a level "L" and is flowing in the direction as indicated by the arrow in FIG. 1. Water level "L" may vary considerably from 0 to maximum.

The covering system of the present invention consists of a plurality of individual covering sections 30, 30A, etc. longitudinally spaced-apart. Each covering section consists of a plurality of individual longitudinal strips 32, 32A, 32B, etc. having a free end 35 allowing movement up and down and a fixed end 36 secured to a transverse support 40 extending between the upper edges of opposite canal banks 20 and 22. The individual strips 32, 32A, . . . are fabricated from a liquid impermeable material such as fiberglass, polyethylene or a laminate having a lamina of vinyl or other flexible plastic and one or more laminae of glass fabric for wear resistance. The particular material used will depend on the economic considerations as well as the environmental considerations and therefore a number of suitable materials will be apparent to those skilled in the art. The material should also be suitably resistant to deterioration by ultraviolet radiation and if plastic material is used, an ultraviolet inhibitor should be incorporated into the material. The material should also be flexible and relatively light for ease of maintenance, transportation, installation and safety. The strip material should also have a selected specific gravity which approximates that of water so that the individual strips 32, 32A, 32B . . . will float on the surface "L" of the water within the canal.

The overall width of each section 30 of the canal cover consisting of a plurality of individual strips 32, 32A, . . . has a width approximating the mean width of the canal at an average flow condition. Adjacent sections 30, 30A overlap at area 38. The longitudinal length of the overlap of adjacent sections 30 and 30A depends on the variation in the normal water level of the canal as well as the distance between the top of the canal and the mean or average water level. The length of the overlap 38 should be sufficient so that an overlap is maintained for all water level conditions L from the top of the canal to low flow levels. On curves, the length of the individual cover strips in a section may vary and the appropriate length is selected with reference to the tangent of the curve and the distance between adjacent transverse supports.

The spacing D between adjacent supports 40 is selected so that the overall length of the strips is a convenient length for installation and maintenance. Similarly, the width of the individual strips, 32, 32A, . . . , etc., is conveniently selected and is determined by a standard width for the particular material selected. It has been found, for example, that in the case of a canal being 60 feet in width that individual strips of approximately 3 ft. in width is convenient. Similarly, for a canal of the width mentioned above and having a mean depth of 10 ft., longitudinal spacings between transverse supports of approximately 30 feet is acceptable with overlap 35 being approximately 15 feet.

Figure 1:
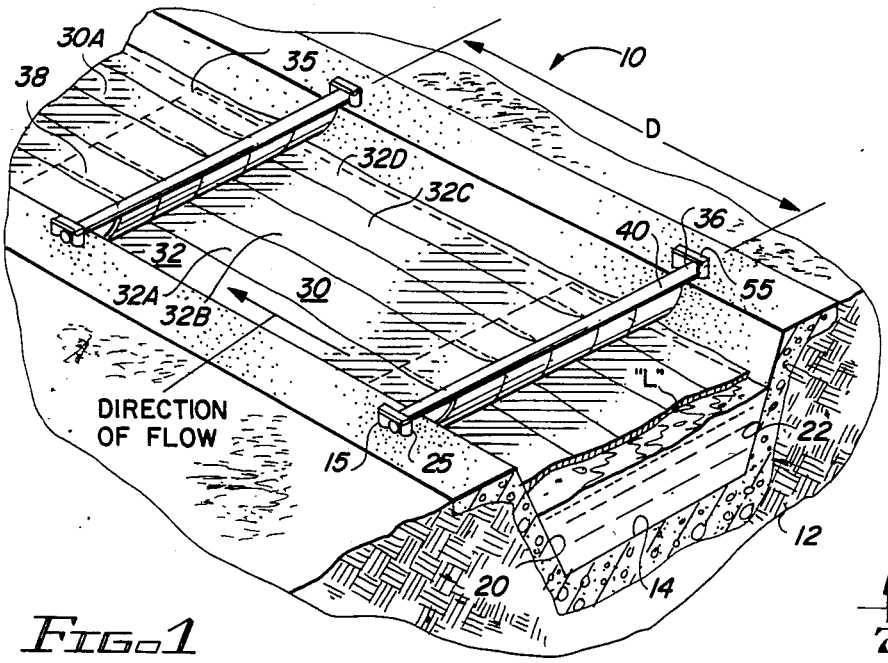
FIG. 1 is a perspective view of a section of a typical canal with the system of the present invention installed therein.
Figure 2:
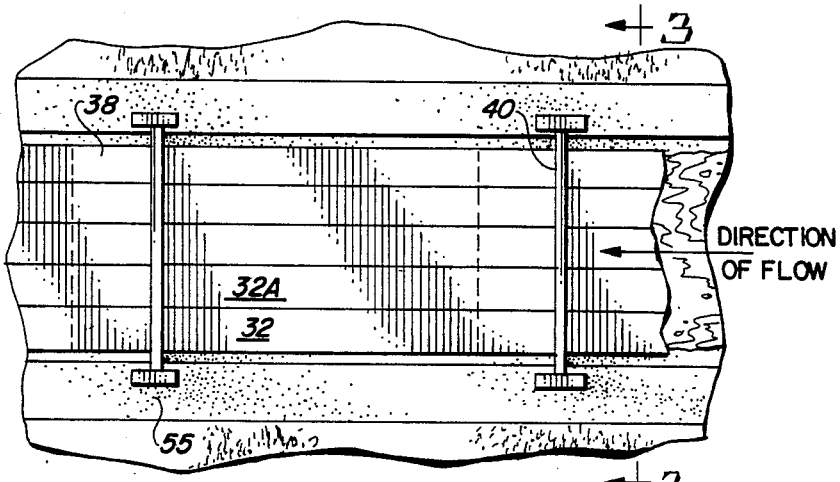
FIG. 2 is a plan view of the canal section shown in FIG. 1.
Figure 3:
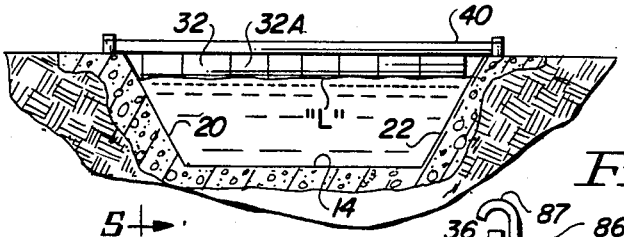
FIG. 3 is a sectional view taken along lines 3—3 of FIG. 2.
Figure 4:
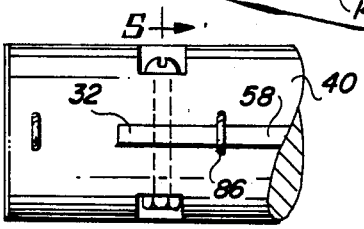
FIG. 4 is a detail view of one end of the cover support which extends transversely across the canal to support the cover section.
Figure 5:
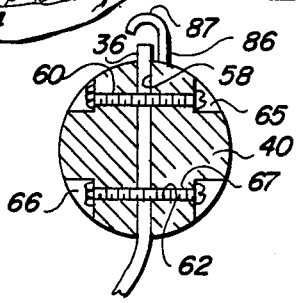
FIG. 5 is a sectional view taken along lines 5—5 of FIG. 4.

The transverse support 40 may be variously constructed however a generally cylindrical pipe as shown in FIGS. 4 and 5 works well. The pipe 40 may be of any suitable material such as aluminum or galvanized steel and is anchored directly into the top of the canal banks 20 and 22 at opposite sides or, as shown in FIGS. 1 to 3, is received within a seat consisting of spaced-apart vertical posts 51 and 52, secured in the top of canal banks as seen in FIGS. 10 and 11. A horizontal cap 55 extends between the top of the post having member 75 securable in the anchor posts 75 and secured by set screw 77. The posts 51 and 52 receive the transverse support 40 snugly to prevent twisting or turning and set screw 77 engages support 40 to further resist movement of the support.

As represented in FIGS. 4 and 5, support 40 is provided with a diametrically extending slot 58 which corresponds approximately to the width of the canal terminating at a location inwardly from the ends of the support 40. Slot 58 receives the fixed ends 36 of the individual cover strips which are held in place by pairs of fasteners 60 and 62 in bores 67 which extend through the support at spaced-apart locations intercepting the slot 58 and extending through the ends of the strips. Recesses 65 and 66 are provided at the opposite ends of the bores 67 to receive the head of fasteners 60 and 62 and the associated nut and washer which secure the individual strips in place. Accordingly, these strips can be easily inserted or removed as required by appropriately inserted or removing the fasteners associated with the individual strips 32, 32A. Hooks 86 extend from the upper surface of support 40 at spaced-apart locations along its length to facilitate installation as will be described hereafter.

When the system as described above is installed with sections 30, 30A, etc. at predetermined spaced-apart locations along the canal, a covering is provided which extends substantially over the entire canal surface. In hot weather the cover system minimizes evaporation. In cooler weather, the covering system will serve to prevent or reduce the formation of fog which can create safety hazards to traffic adjacent canals. The individual cover strips, each having a specific gravity approximately that of water, will cover the water and float on the surface when the water is in a quiescent condition. The strips will also follow fluctuations in water level L rising or falling as the water level varies. Water flow, either laminar or turbulent, will not affect the strips and they will remain in place. In extremely cold weather, the covers will serve to minimize the formation of ice on the canal surfaces. The sections are also safe and if a person or animal falls into the canal, the individual strips should not seriously affect extraction of the person or animal.

The overlap 38 between adjacent sections 30 and 30A insures complete coverage for all water level and flow conditions. It will be apparent that the system is easy to install and maintain and that when necessary, an individual section 30 can be removed by removing the cover 55 from its anchored position to access the section for necessary repair.

Figure 7:
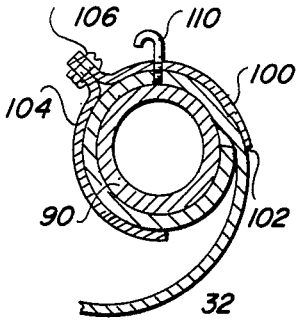
FIG. 7 is a view along lines 7—7 of FIG. 6.
Figure 6:
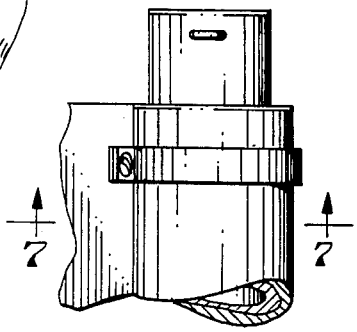
FIG. 6 is a detail view of the end of another support arrangement which may be used with the system of the present invention.

FIGS. 6 and 7 illustrate another embodiment of the transverse support for the cover strips. In this embodiment, the support 90 is again shown as a generally cylindrical member such as a metal pipe having an annular wall. The individual covering strips 32, 32A, etc., are secured at their fixed end and are wrapped about the support 90 in at least one complete wrap as shown. The individual covering strips 32, 32A, etc. are secured adjacent one another to the support by clamps 100 at selected spaced-apart locations transversely along the support. The clamps 100 consist of opposed arcuate members 102 and 104 each extending at least 90° along the surface of the strips and secured at one end by fastener 106. A plurality of line hooks 110 extend vertically from the support to permit installation as has been described with reference to FIGS. 12 and 13.

Figure 9:
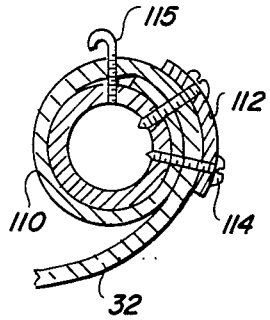
FIG. 9 is a view taken along lines 9—9 of FIG. 8.
Figure 8:
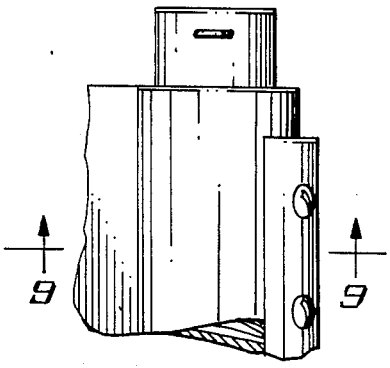
FIG. 8 is an end view illustrating still another support arrangement for the cover strips.

Still another form of attachment of the strips to the anchor support is shown in FIGS. 8 and 9. In these figures, the support 110 consists of an annular pipe of suitable material adapted to extend transversely across the canal. The fixed end of the strips 32, 32A . . . are wrapped around the exterior of the support 110 approximately one and a half times to form an overlap area on the support as shown in FIG. 9. An arcuate clamp cover 112 having a transverse dimension less than the width of each of the individual strips 32, 32A, etc. is placed in the overlap area and secured to the support 110 by one or more fasteners 114 extending into the support. The fasteners 114 can be screws of the self-tapping type engageable in the support. Line hooks 115 are provided at spaced-apart locations along the support. Accordingly, the present and other embodiments showing various attachment arrangements for the strips all provide a convenient way of securing the strips permitting efficient replacement of the strips when necessary.

It will be apparent to those skilled in the art that the covering system described above may be installed in various ways. However, one particularly convenient way of installing the system utilizing workmen on opposite canal banks is shown in FIGS. 12 and 13. In these figures, the canal 10 is traversed by a cable 80, extending between the anchor posts 51 and 52 at opposite sides of the canal and secured to stakes 70 and 72. A plurality of suspension hook members 86 are secured to the upper side of the transverse supports 40. The suspension members 86 have a hook section 87 which is engageable on the transverse cable 80. Accordingly, as shown in FIG. 13, the individual sections may be positioned by suspending the support 40 and attached cover strips on the cable 80 and manually advancing the support 40 across the canal until it is secured in position between the anchor posts 51 and 52 at the opposite canal banks. Cap 55 is then secured in place to complete the installation and the cable 8 is then removed.

FIG. 15 illustrates another embodiment for the anchor securing the opposite ends of the transverse support 120. In this embodiment, each anchor 125 consists of a post 126 supporting a pair of arms 128 and 130 defining a cradle or seat for supporting the transverse support 120 inwardly of its ends. The support arms open upwardly so that the transverse support member 120 may be lifted into and out of the cradle to facilitate installation and removal from one side of the canal. As seen in FIG. 15, the transverse support 120 is cylindrical having a pair of diametrically opposed lugs 132 for receiving a drive member as will be explained with reference to the method of installation as described in FIGS. 16 to 18.

Referring to FIGS. 16 through 18, the individual cover sections are transported to the canal jobsite by a truck 140 especially equipped for the purpose. The truck has an elongate bed 147 which is divided into two adjacent sections 148 and 149. Section 148 is provided with a plurality of canal cover sections 150 which are rolled about pipe support 120 in a manner as shown in FIG. 19. The opposite truck bed section 149 is for receiving sections which have been removed and prior to removal have been rolled similar to that shown in FIG. 19. Vehicle 125 further carries a crane 152 which is adapted for raising and lowering the individual sections 150 and which can be operated to maneuver the transverse supports into position across the canal and also remove the sections. To position a cover section, it is necessary to attach the opposite ends of the transverse support 120 to the crane cables as shown in FIG. 16. The crane is then operated to position the rolled section 150 with the opposite ends of support 120 in anchors 125 at the opposite canal banks 20 and 22. The crane and cables are then detached by using a snap hook with a tether line so the snap hook can be remotely disengaged or by using other similar arrangements as known to those in the art.

As seen in FIG. 18, vehicle 125 is further provided with a remote drive 160 such as a hydraulic motor driven from the hydraulic system of the vehicle. The hydraulic drive has a coupling 162 which may be extended to engage the drive lugs 132 on the support 120 to roll sections as shown in FIG. 19 for easy removal. Removal is then accomplished by remotely attaching the crane lines to the support 120 and lifting the support to the truck bed section 149.

It will be obvious to those skilled in the art to make various changes, alterations and modifications to the canal covering system and method described herein. To the extent such changes, alterations and modifications do not depart from the spirit and scope of the appended claims, they are intended to be encompassed therein.

I claim:

1. A floating cover system for a water transportation canal having opposite banks and defining a channel therebetween for containing water with the surface of the water exposed to the environment, said cover system comprising:

(a) a first cover assembly including:
  (i) anchor means located at opposite banks;
  (ii) a transverse support member extending between said anchor means and removably received therein; and
  (iii) cover means having a free end and a fixed end secured at said support member and adapted to float upon and overlie the fluid surface;

(b) a second cover assembly including:
  (i) anchor means located at opposite banks;
  (ii) a transverse support member extending between said anchor means and removably received therein; and
  (iii) cover means having a free end and a fixed end secured at said support member and adapted to float upon and overlie the fluid surface; and (c) said second cover assembly being spaced from said first cover assembly a predetermined distance along said canal whereby a portion of the first cover assembly spaced from the said free end of the first cover assembly overlaps a predetermined portion of the second cover assembly when fluid is flowing in the said channel.

2. The cover assembly of claim 1 wherein said cover means each has a width approximately equal to the width of the canal at the mean water level.

3. The floating cover system of claim 1 wherein said first and second cover comprise a plastic and fiberglass sheet.

4. The cover system of claim 1 wherein said cover means have a specific gravity approximating that of water.

5. The cover system of claim 1 wherein said support members have a a generally circular cross-section and the fixed end of said cover means are each removably clamped to the said associated support.

6. The cover system of claim 1 wherein said supports define a slot with said fixed ends of said covers between removably retained at said slot in the associated support.

7. The cover system of claims 5 or 6 wherein said supports each include a plurality of engagement members for temporarily positioning said support across said canal on a cable.

8. The cover system of claim 1 wherein said anchor means each comprise a pair of spaced apart posts adapted to receive the end of a support member and further including a cover extending therebetween.

9. The cover assembly of claim 8 further including restraining means to prevent movement of said support relative to said anchor means.

10. The cover assembly of claim 1 wherein said cover means each comprises a plurality of elongate strips.

* * * * *